United States Patent [19]

Governale

[11] 3,967,845

[45] July 6, 1976

[54] REINFORCED STRIKER ASSEMBLY FOR DOOR LOCKS

[75] Inventor: Bernard C. Governale, Duluth, Ga.

[73] Assignee: Peachtree Doors, Inc., Norcross, Ga.

[22] Filed: Oct. 21, 1974

[21] Appl. No.: 516,485

[52] U.S. Cl. ..... 292/340; 292/346

[51] Int. Cl.[2] ..... E05C 1/00

[58] Field of Search ..... 292/340, 346; 85/13

[56] References Cited

UNITED STATES PATENTS

| | | | |
|---|---|---|---|
| 2,127,891 | 8/1938 | Starling | 292/346 |
| 2,484,024 | 10/1949 | Garberding | 292/346 |
| 2,973,175 | 2/1961 | Appleton | 85/13 |
| D34,243 | 3/1901 | Taylor | 292/346 X |

*Primary Examiner*—Richard E. Moore
*Attorney, Agent, or Firm*—D. Paul Weaver

[57] ABSTRACT

A metal reinforcing plate is arranged beneath the usual striker plate in a routed recess of the wooden door jamb. The reinforcing plate has integral anchoring prongs which are driven into the wooden jamb immediately ahead of the stop rail and has additional anchoring and locator tabs which are received at the side walls of the bolt receiving recess or socket in the door jamb. The reinforcing plate is substantially concealed from view while imparting to the door structure substantial extra strength against forceable entry.

8 Claims, 4 Drawing Figures

FIG. 1
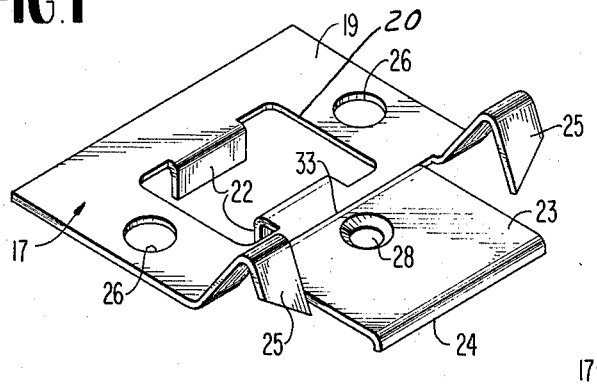
FIG. 2
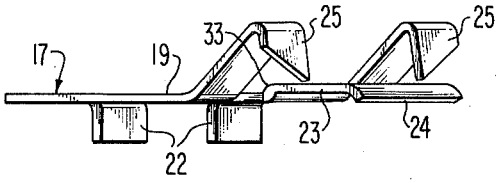
FIG. 3
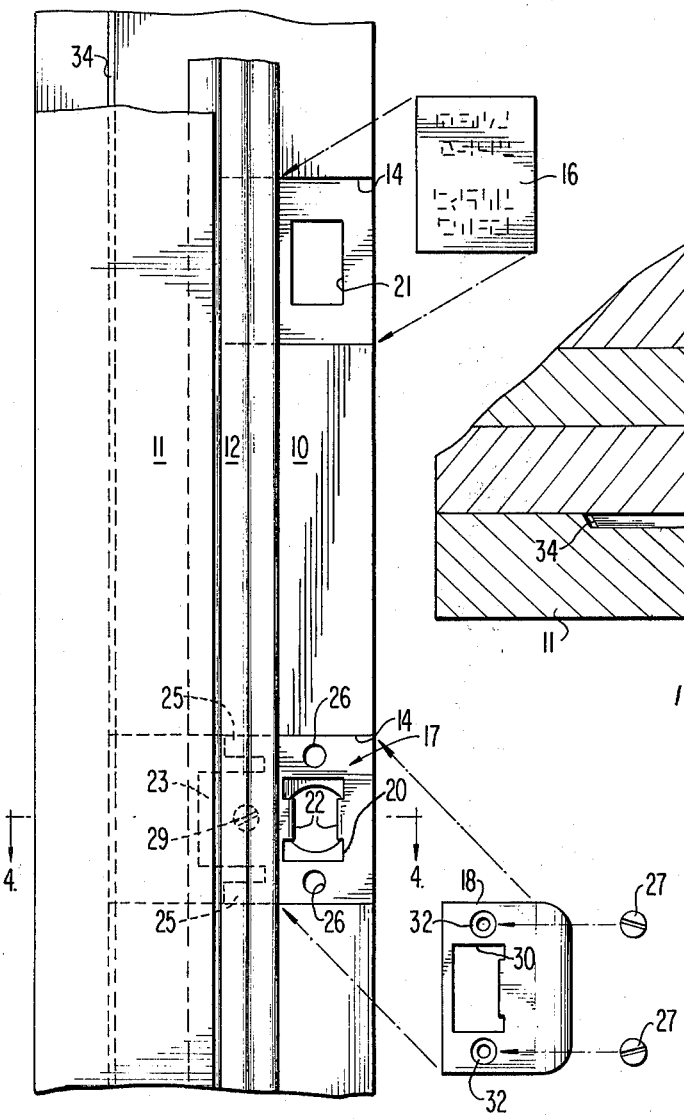
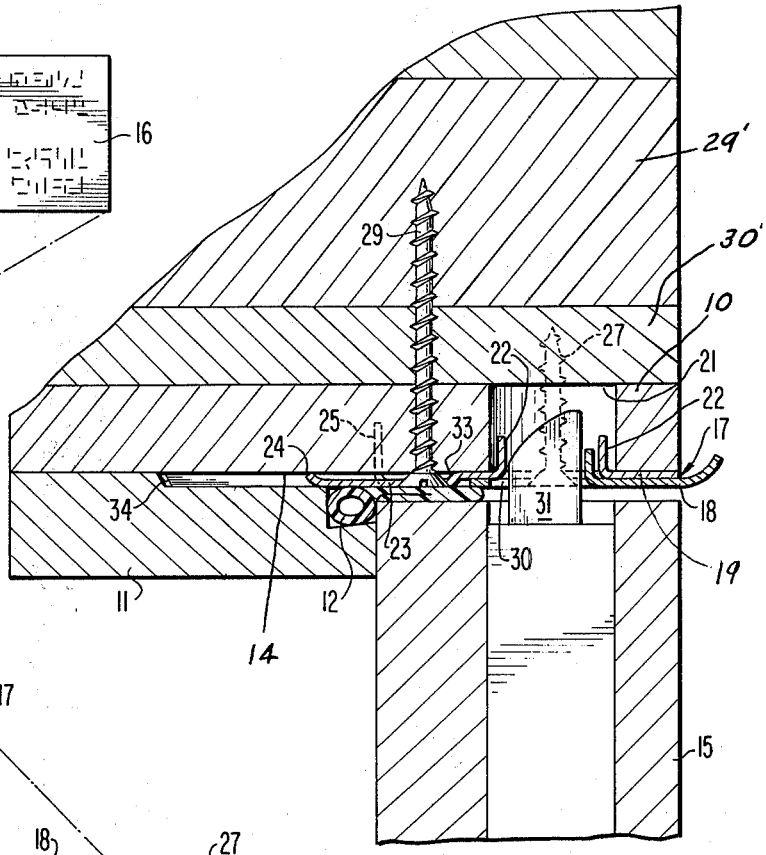
FIG. 4

REINFORCED STRIKER ASSEMBLY FOR DOOR LOCKS

BACKGROUND OF THE INVENTION

The extreme weakness of doors in modern day homes and other buildings making them unable to resist forceable entry to any reasonable degree is a very serious and widely recognized concern or problem. Even in costly homes, a shoulder against the door or a stout kick with the foot will open it when locked or bolted. If the door panel itself is made strong, the door will still yield due to the inherent weakness of the jamb structure and the mounting of the striker plate which is relied upon to interlock with the bolt. The use of a strong lock and lock bolt is of no avail so long as the inherent weak arrangement of jamb and striker plate mounting is adhered to.

The problem has been recognized in the prior art and solutions to it have been proposed. One example of a patented prior art solution is disclosed in U.S. Pat. No. 3,764,173, issued Oct. 9, 1973 to Griffith. While Griffith successfully reinforces the usual striker plate and associated jamb, he does so with a rather large and complex plate attachment which spans the entire door frame and constitutes an unsightly and unacceptable element to most home owners. In comparison to the Griffith solution, the present invention successfully strengthens or reinforces the vital striker plate structure without changing or detracting from the conventional uncluttered appearance of the door frame and adjacent structure. The reinforcing plate forming the main element of the invention is concealed beneath the conventional striker plate during use and also concealed by an overlapping part of an attendant seal or weather strip.

Other aspects and advantages of the invention will become apparent during the course of the following description.

BRIEF DESCRIPTION OF DRAWING FIGURES

FIG. 1 is a perspective view of a striker plate reinforcement according to the invention.

FIG. 2 is a further perspective view thereof.

FIG. 3 is an exploded side elevational view of the invention in relation to a door frame which has been prepared to accept the invention.

FIG. 4 is an enlarged fragmentary horizontal section through a door jamb and door utilizing the invention and taken through the jamb on line 4—4 of FIG. 3.

DETAILED DESCRIPTION

Referring to the drawings in detail, wherein like numerals designate like parts, reference is made first to FIG. 3 showing a fragment of one side of a vertical door jamb 10 having a stop rail 11 suitably attached thereto, with a weather strip or seal 12 formed of plastic or the like held within a recess between the stop rail and jamb and projecting forwardly thereof as shown in both FIGS. 3 and 4.

The door jamb 10 is routed in two rectangular areas 14 to accept two units of the invention in cases where a door 15, FIG. 4, has primary and secondary locks at two vertical elevations, as is quite common. In other cases, where only a primary lock is utilized, one of the routed recesses 14 will not be used and only one unit of the invention need be employed as illustrated in the drawings. In such a case, the upper routed recess 14 of the door jamb can be neatly covered and concealed beneath an identification tag 16 which may bear a trademark used on the invention or other desirable advertising indicia. The tag or plate 16 may be formed of molded nylon or the like of a sufficient thickness to fill the unused recess 14 when mounted therein adhesively or otherwise. The rear portion of the unused recess will be overlapped and concealed by the projecting portion of the weather strip 12.

Since each unit of the invention will be identical with other units, a complete description of one unit will be sufficient to describe the invention. Such unit, now to be described, will be mounted in the lower routed recess 14 of the door frame as shown in FIG. 3. The recess 14 is sufficiently deep to accommodate both the reinforcement plate 17 of the invention and the conventional striker plate 18 applied to the outer face of the reinforcement plate as shown in the drawings.

The reinforcement plate 17, forming the key element of the invention, embodies a rectangular body portion 19 formed to fit into the recess 14 and having a central rectangular opening 20 to register in assembly with the usual door lock bolt receiving socket 21 formed in the door jamb. At the forward and rear sides of the opening 20, plate body portion 19 carries integral rigid right angular anchoring and alignment tabs 22 which enter the socket recess 21 and lie against its forward and rear side walls, as best shown in FIG. 4. These tabs in addition to aligning the reinforcement plate 17 lock the same against fore and aft displacement relative to the door jamb.

The reinforcement plate 17 further embodies a reduced width rearward tongue 23 having a short inturned flange 24. This tongue and flange portion of the reinforcement plate is received in the rearward part of routed recess 14.

The reinforcement plate 17 is additionally provided on opposite sides of the tongue 23 with sturdy prongs 25 which are initially raised from the plane of the body portion 19 prior to the mounting of the invention. When the reinforcement plate is mounted, FIGS. 3 and 4, the prongs are driven down with a hammer so that their right angular pointed portions penetrate the door jamb 10 and lie at right angles to the plate body portion 19 as clearly shown in FIG. 4. These prongs further anchor and stabilize the reinforcement plate on the jamb to prevent its dislodgement during an attempted forceable entry through the door by an intruder.

Above and below the opening 20, reinforcement plate 17 has a pair of apertures 26 for screws 27 which pass well into the door frame 10 above and below bolt socket 21. A third aperture 28 rearward from the apertures 26 and midway therebetween is formed through the tongue 23 and accepts a third long screw 29. Thus, the reinforcement plate is further anchored to the door jamb by the two described screws 27, and the third long screw 29, which passes through the door jamb and penetrates the adjacent wall stud 29', inwardly of the shim 30'.

The conventional striker plate 18 shown separated in FIG. 3 is applied to the outer side of reinforcement plate 17 and is flush with the door jamb surface. It has a central opening 30 to accept the door bolt 31 and is in registry with the socket 21 and the opening 20 of the reinforcement plate when the parts are assembled as in FIG. 4. The striker plate 18 has apertures 32 above and below the opening 30 which receive the two screws 27 to be anchored thereby.

It may now be noted that when the invention is assembled to the door frame, its appearance is conventional and no unsightly attachments are visible to an observer. The rearward elements 25 and 23 are concealed beneath the projecting part of weather strip 12. The remainder of the reinforcement plate 17 is covered and concealed by conventonal striker plate 18. Nevertheless, the invention greatly improves and multiplies the strength and resistance of the door to foreceable entry. If the door 15 and its lock are of sturdy construction, it will be impossible for an intruder by means of his shoulder or other physical force to effect a forceable entry because the reinforced striker plate in coaction with the bolt 31 will resist this. In contrast, with weak conventional structures, the intruder is able to force the door with little difficulty, breaking off the stop rail 11 and ripping the weakly anchored striker plate from the door jamb. Another advantage of the invention is that it is completely compatible with conventional door hardware of many makers, requires no modification of standard or existing locks and does not interfere in any way with the normal use or operation of these components. The many advantages of the construction should now be apparent to those skilled in the art.

As shown, the entire extension or tongue 23 is slightly offset in a plane parallel to the body portion 19 and this offset construction forms a shoulder 33 between the elements 19 and 23. The numeral 34 denotes a recess in the stop rail 11.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. Means to resist forceable entry through a bolted door which is swingable with relation to a fixed surrounding door frame having a bolt receiving socket and an adjacent striker plate recess, said means comprising a reinforcement plate disposed in the bottom of said recess and having a pair of opposed anchor tabs projecting into said socket and engaging the forward and rear walls thereof, prongs on said reinforcement plate rearward of said tabs and being driven into a door jamb rearward of said socket to further anchor the reinforcement plate, and a conventional striker plate mounted on the outer face of said reinforcement plate and each having a bolt receiving opening in registry with the bolt socket, the conventional striker plate covering and substantially concealing the reinforcement plate from view, and anchor screw means common to the reinforcement plate and said conventional striker plate penetrating into an adjacent door jamb portion, and further penetrating the adjacent wall stud.

2. The structure of claim 1, and said prongs comprising a pair of spaced apart bendable generally L-shaped prongs on a rearward edge portion of the reinforcement plate which are initially elevated from the plane of the reinforcement plate and adapted to be driven down to lie in said plane with pointed portions of the prongs penetrating the jamb substantially at right angles to the reinforcement plate.

3. The structure of claim 1, and a rearward offset extension on the reinforcement plate between said prongs including an inturned flange adapted to engage the adjacent jamb portion for further anchorage of the reinforcement plate.

4. The structure of claim 3, and a weather strip element overlapping said prongs and rearward extension and concealing them from view immediately rearwardly of the conventional striker plate, the latter being flush with said jamb.

5. The structure of claim 1, and said anchor screw means comprising a pair of apertures in said reinforcement plate and conventional striker plate above and below said bolt socket and being in registry, and a pair of screws extending through said apertures and penetrating into said door jamb above and below said bolt socket.

6. The structure of claim 5, and a third longer anchor screw for the reinforcement plate and rearwardly of the conventional striker plate and bolt socket and offset from said pair of screws, said third anchor screw penetrating through said jamb and into an adjacent wall stud.

7. The structure of claim 6, and a weather strip element on said jamb vertically and overlying and concealing said third anchor screw and adjacent parts of said reinforcement plate.

8. A reinforcement plate for application at one side of a door jamb ahead of a stop rail and in underlying relation to the conventional striker plate and adjacent a door bolt socket said jamb, said reinforcement plate comprising a rectangular plate body having a substantially central rectangular bolt receiving opening and a pair of anchor screw apertures above and below said opening, a pair of right angular locating and anchoring tabs on said plate body projecting beyond one side thereof at the sides of said bolt receiving opening which are vertical during use, integral substantially L-shaped pointed prongs on the two rearward corners of the plate body and being elevated from the plane of the plate body prior to being driven downwardly into use positions, a rearward tongue extension on the plate body between said prongs having an anchor screw aperture offset rearwardly from said screw apertures and spaced rearwardly, of said bolt receiving opening and said tabs, and a short generally right angular flange on the rearward end of said tongue extension facing in the direction of said prongs.

* * * * *